United States Patent [19]

Hamilton

[11] Patent Number: 4,530,451

[45] Date of Patent: Jul. 23, 1985

[54] COMBINATION BACK PACK/BEACH CHAIR

[76] Inventor: James Hamilton, 189 Upland Rd., Cambridge, Mass. 02140

[21] Appl. No.: 555,652

[22] Filed: Nov. 28, 1983

[51] Int. Cl.[3] ..... A45F 4/02

[52] U.S. Cl. ..... 224/155; 297/1; 224/153

[58] Field of Search ..... 224/156, 159, 155, 153, 224/151, 213, 259, 210; 297/1, 2, 16, 191; 248/351

[56] References Cited

U.S. PATENT DOCUMENTS

| | | | |
|---|---|---|---|
| 2,140,310 | 12/1938 | Brown et al. | 297/1 |
| 2,570,571 | 10/1951 | Leeman | 190/8 |
| 2,973,888 | 3/1961 | Beardsley | 224/155 |
| 3,307,758 | 3/1967 | Platt | 224/155 |
| 3,315,856 | 4/1967 | Black | 224/155 |
| 3,342,294 | 9/1967 | Beatty | 190/8 |

*Primary Examiner*—Stephen Marcus
*Assistant Examiner*—Robert Petrik
*Attorney, Agent, or Firm*—Wolf, Greenfield & Sacks

[57] ABSTRACT

A multiple function assembly used both as a seat and a back pack. The assembly includes two hinged-together sections that articulate over an arc of about 45 degrees. A seat pad is hinged to the free end of one section and a storage bag detachably engages the other section. When the seat pad is pivoted to a position parallel with the section to which it is attached, the assembly functions as a back pack. When it is pivoted to an obtuse angle, the assembly functions as a seat with a back rest.

4 Claims, 5 Drawing Figures

Fig. I

COMBINATION BACK PACK/BEACH CHAIR

SUBJECT MATTER OF INVENTION

The present invention relates to a multiple function assembly used both as a seat with a back rest and as a back pack.

BACKGROUND OF INVENTION

Heretofore there has been made available and disclosed a variety of collapsible seats that function as combination chairs or seats and storage containers. The most pertinent of these of which the inventor is presently aware is disclosed in the Kjaer Pat. No. 4,300,707. A variety of other designs, however, also exist as exemplified by the following patents: U.S. Pat. Nos. 2,843,185, 2,922,465, 3,250,449, 3,266,686, 3,662,932, 3,315,856, 4,286,739, 4,300,707, 4,387,924.

While these prior art references each have some advantages, none of them provide the combination advantages of a back pack and seat that is particularly designed and adapted for a backrest at a beach, back packing or similar activities. Further, the references referred to are either cumbersome in appearance or relatively expensive in design. In particular, the Kjaear reference provides hinged-together members which do not lie flat against one another when folded, nor does it provide an A-frame style back rest which is particularly desirable and comfortable when used on a beach. Others of the references referred to above involved X-frame supports that provide means for combining back packs and seats. These X-frames also do not provide an ideal type of A-frame backrest support or compact construction of the type contemplated in the present invention.

SUMMARY OF THE INVENTION

The present invention is designed to provide an improved combination back pack and backrest combination especially designed for use in the outdoors for such purposes as picnicing, back packing and beach use. A further object of the present invention is to provide an improved combination back pack and seat that is simple to manufacture, inexpensive, easy to maintain, sturdy in appearance and construction and easy to use or convert. A further object of the present invention is to provide a simple back pack seat combination which is readily converted from a back pack to a seat in which the seat includes a seat pad and A-frame back rest.

A further feature of the present invention includes a combination of the type described with a storage or pack bag that may be readily engaged and disengaged from the frame by integrally formed molded hooks as well as a seat pad that pivots to and from a storage position between frame members. The present invention additionally provides dual function straps that permit conversion of the assembly from a back pack to a seat position and in which these straps are used to carry the assembly when used as a back pack and to secure the assembly in a seat position when used as a seat.

In the present invention a multiple function assembly is designed for use as a seat or back pack and includes a frame assembly with a front section and a back section. These sections are hinged together for articulating movement over a 45 degree angle. A seat pad is pivotally secured to the lower free end of one of these sections for pivoting movement between a seat position and a storage position. A storage bag conforming with the other of these sections is detachably secured to it.

BRIEF DESCRIPTION OF DRAWINGS

These and other objects and advantages of the present invention will be more clearly understood when considered in conjunction with the accompanying drawings, in which.

DETAILED DESCRIPTION OF DRAWINGS

Figure 1:
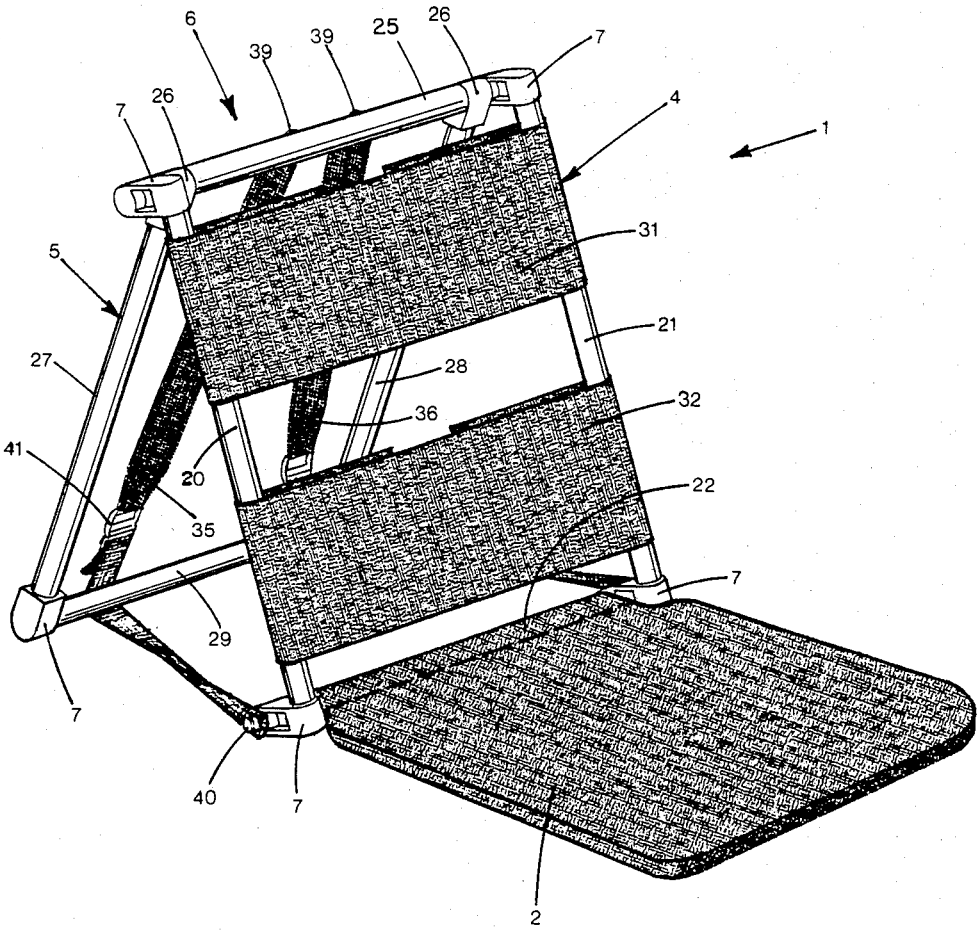
FIG. 1 is a perspective view of the seat position of the combination seat and back pack in an open position.
Figure 2:
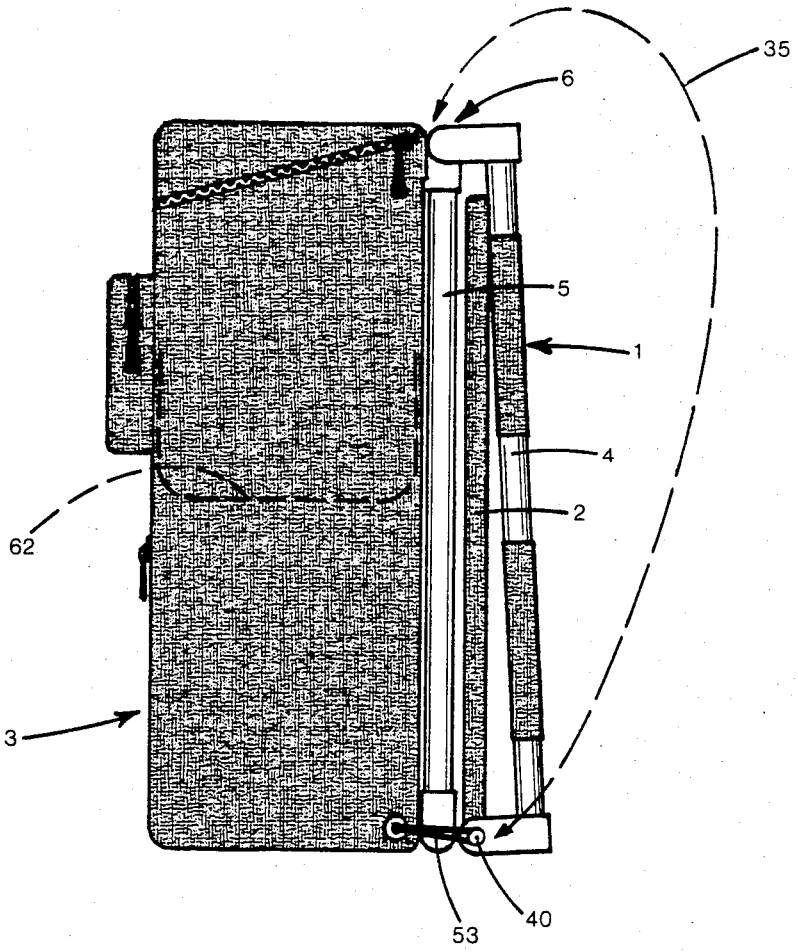
FIG. 2 is a side elevational view of a combination seat and back pack in a storage position.
Figure 3:
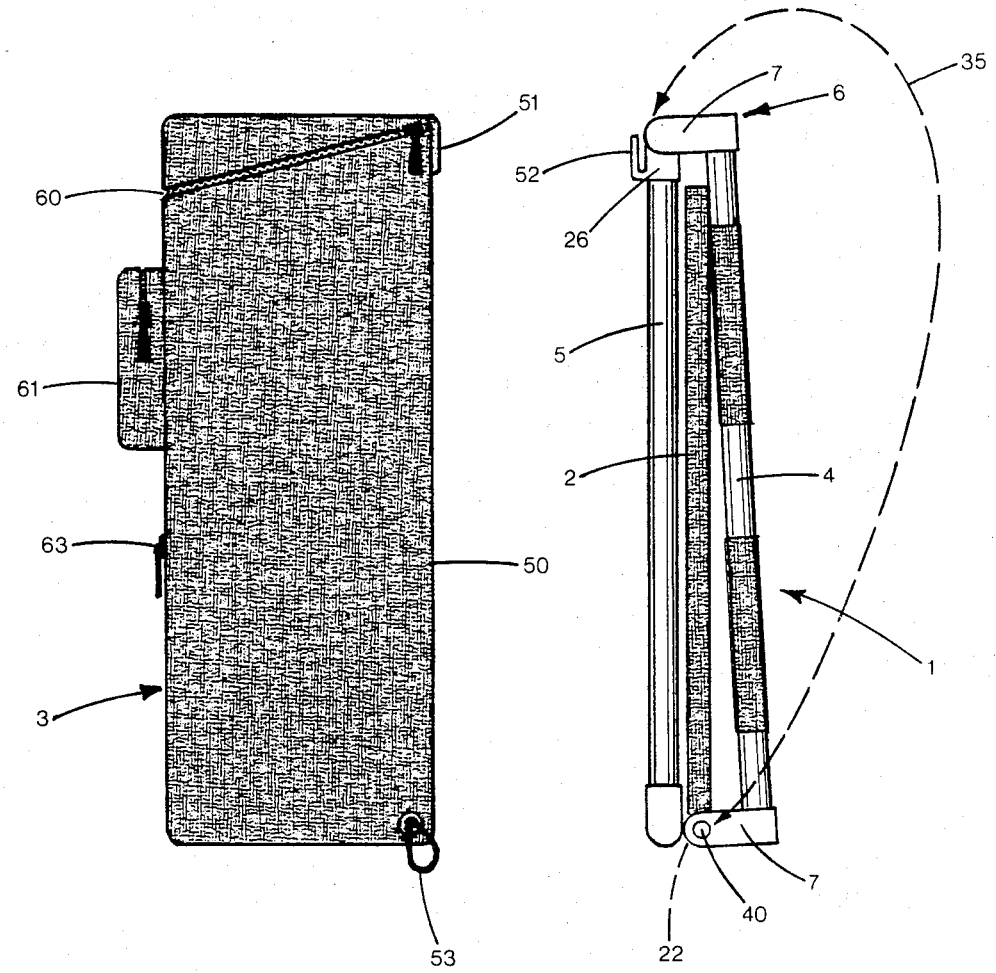
FIG. 3 is a side elevational view of a combination seat and back pack with the storage bag detached from the frame assembly.
Figure 4:
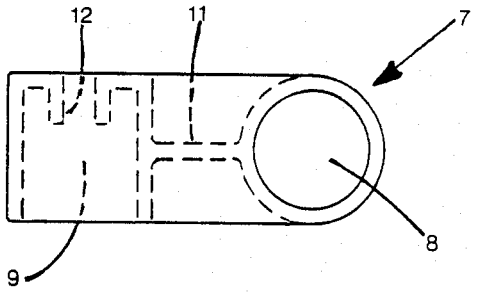
FIG. 4 is a top view of a connector component used in the assembly of the invention.
Figure 5:
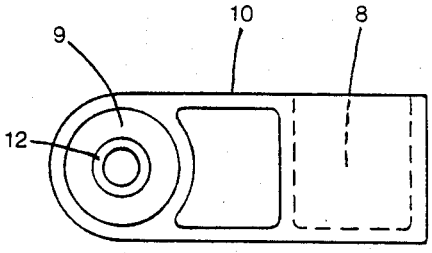
FIG. 5 is a side view of the connection of FIG. 4.

The multiple function assembly illustrated in the accompanying drawings is used primarily as a seat with a back rest or back pack. The principal components of this assembly include a frame assembly 1, a seat pad 2, and a storage bag 3 (FIGS. 2 and 3). The frame assembly 1 is formed with a front section 4 and a back section 5. Means 6 are provided for hinging the front and back sections together for articulating relative to one another over an arc of substantially 45 degrees. A side elevation of the frame FIG. 3, illustrates the closed or storage position of the frame assembly while the seat position of the frame assembly is illustrated in FIG. 1. The means 6 for hinging front and back sections together comprises primarily a molded plastic connector 26 which is designed as universal connector for inter-engaging the tubular structural frame members. The connector 7 (FIGS. 4 and 5) is formed of a body having a cylindrical recess 8 at right angles to a second cylindrical recess 9. Walls 10 of this connector may be reinforced by a recessed wall 11. An annular reinforcing boss 12 is formed co-axially with the opening 9.

As illustrated in FIGS. 1 and 2, tubular members 20 and 21 form the sides of the front section 4. The lower ends of these tubular members 20 and 21 are inter-engaged by a tubular member 22 shown in dotted outline. The adjacent ends of tubular members 21 and 22, and 20 and 22 are inter-engaged by a connector 7. The seat pad 2 made of fabric material is formed with a fabric loop, through which the tubular member 22 extends. As illustrated in FIG. 3, the tubular member 22 is offset from the plane in which tubular members 20 and 21 lie, therefore permitting articulation of the seat pad 2 between the front section 4 and the rear section 5. Seat pad 2 should be shaped and sized to fit within the periphery defined by the tubular members 20, 21 and 22 and the upper tubular member 25. Upper tubular member 25 is secured between tubular members 20 and 21 by another set of connectors 7 in the manner similar to the connection of tubular member 22. Tubular member 25 carries a pair of connectors 26 that are modified to secure the upper ends of tubular members 27 and 28 which form the side members of the back section 5. A lower tubular member 29 is secured at opposite ends between the tubular members 27 and 28 by connectors 7. The offset of connectors 7 at the upper end of the front section 4 provides a space between the front and back sections 4 and 5 sufficient to permit storage of the seat 2 as illustrated in FIG. 3.

A pair of woven fabric bands or back rests made of similar or equivalent material, illustrated at 31 and 32, are suitably secured between the tubular members 20 and 21 to provide a back rest for use in conjunction with seat 2. In addition, these back rests 31 and 32 also function to engage a wearer's back when the unit is in the storage position and carried by a wearer.

A pair of shoulder straps 35 and 36 are secured to the assembly, with the upper ends of these straps secured by suitable rivet means 39 to the tubular member 25. The lower ends of the straps 35 are secured, one each, to the double-headed rivet 40 which engages the connector 7. The double-headed rivet is seated in the annular member 12. (See FIG. 4). The straps 35 may be adjustable, as illustrated at 41. When the straps are in a seat position, as illustrated in FIG. 1, they are positioned over the back section, engaging the tubular member 29 to hold the frame assembly at substantially a 45 degree angle. When the shoulder straps are in a storage or carrying position, they are positioned forward of the front section 4, so as to be engaged by a wearer.

The storage bag, as illustrated in FIGS. 2 and 3, is preferably rectangular in configuration, having sidewalls backwall and a front wall 50. The front wall 50 is preferably rectangular in shape, and is sized in dimension to conform substantially to the outline of the back section 5. A stiffener 51 is secured to the wall 50, with suitably designed receptacles to engage hook member 52 integrally formed with the connector 26. In use, the bag 3 is hooked onto the frame assembly by inter-engaging the stiffener 51 with the hooks 52 of the connectors 26. The lower end of the bag is thereafter inter-engaged with the frame assembly by means of the elastic cord 53, which consists essentially of a loop stitched to each side of the corner of the bag. These loops 53 are stretched over and into engagement with the double-headed rivet 40.

The bag 3 may be of conventional design, but preferably is formed with a zipper or closure 60 extending from the upper edges of the bag. Additional storage may be provided with a supplemental pocket 61. In addition the bag 3 may be provided with a divided compartment, suggested by the dotted line 62 in FIG. 2. In such a case the lower compartment would be provided with an opening, preferably having a zipper closure 63 extending across the sidewall. If desired, the upper compartment defined by the dotted line 62 may contain an insulated cooler shaped in essentially a rectangular configuration to fill the upper compartment using such rigid cooler which maintains the general shape of the bag even though the lower half or lower compartment has no rigid wall members.

In use, the unit may be worn as a back pack best illustrated in FIG. 2 or used as a seat as for example on a beach as illustrated in FIG. 1. In this seat configuration, the seat pad 2 lies flat on the ground and the frame sections form a rigid A-frame shape that functions as a back rest.

From the foregoing description, those skilled in the art will appreciate that numerous variations may be made of this invention without departing from its spirit. Therefore, I do not intend to limit the scope of this invention to the single embodiment shown and described. Rather, it is my intention that the scope of this invention be determined by the appended claims and their equivalents.

Having now described my invention, I claim:

1. A multiple function assembly for use as a seat or back pack comprising:

a frame assembly having a front section and a back section, means for hinging said front and back sections together for articulating relative movement in an arc of substantially 45 degrees between a storage position and a use position, a seat pad shaped and sized for storage in flat parallel relation to said front and back sections when said front and back sections are positioned in substantially parallel relation, said front and back sections being positioned parallel to one another with said seat pad therebetween when said assembly is in said storage position, means for securing said seat pad to said front section and permitting movement of said seat pad between said storage position and said use position wherein said seat pad extends at an obtuse angle with respect to said front section, a storage bag having at least one wall shaped and sized to substantially conform with said back section, and means for detachably inter-engaging said storage bag with its one wall in facing engagement with said back section.

2. A multiple function assembly as set forth in claim 1 including a pair of shoulder straps sized to fit over an individual's shoulders for carrying said assembly, said shoulder straps each engaged at one end at the upper end of said frame assembly and at the other end at the lower end of said frame assembly, and adopted to be positioned in front of said front section when said assembly is in said storage position for carrying and over said back section when said frame assembly is in said use position for securing said frame assembly in said use position.

3. A multiple function assembly for use as a seat or back pack comprising:

a frame assembly having a front section and a back section comprised of tubular members, each of said sections being U-shaped with the free ends of the legs of said U-shaped sections pivotally interengaged, means for hinging said front and back sections together for articulating relative movement in an arc of substantially 45 degrees between a storage position and a use position, said front and back sections forming an A-frame when in said use position and positioned in substantially parallel relation when in said storage position, a pair of shoulder straps positioned to engage said front and back sections to limit movement from said A-frame position, a seat pad shaped and sized for storage in flat parallel relation to said front and back sections when said sections are in said storage position, means pivotally securing said seat pad to the bight of said front section and permitting movement of said seat pad between said storage position and said use position wherein said seat pad extends at an obtuse angle with respect to said front section, said hinging means including means for offsetting the hinging axis of said front section from the plane in which said back section primarily rests to space said sections apart in substantially parallel relation when in said storage position with said space being at least substantially the thickness of said seat pad so that said front and back sections are positioned substantially parallel to one another with said seat pad therebetween when said frame assembly is in said storage position, a storage bag having at least one wall shaped and sized to substantially conform with said back section, and means for detachably interengaging said storage bag with its one wall in facing engagement with said back section.

4. A multiple function assembly for use as a seat or back pack comprising:

a frame assembly having a front section and a back section, means for hinging said front and back sections together for articulating relative movement in an arc of substantially 45 degrees between a storage position and a use position, a seat pad shaped and sized for storage in flat parallel relation between said front and back sections when said sections are positioned in substantially parallel relation in said storage position, means for securing said seat pad to said front section and permitting movement of said seat pad between said storage position and said use position wherein said seat pad extends at an obtuse angle with respect to said front section, stop means comprising at least one elongated member having one end secured to the free end of one of said front and back sections and the other end engaging said other section at said hinging means whereby said stop means may be selectively used as a carrier for said assembly when said assembly is in said storage position and as means for limiting articulating relative movement of said front and back sections when said assembly is in said use position, said stop means when used to limit articulating motion having an intermediate segment engaging the free end of the other of said sections, a storage bag heaving at leat one wall shaped and sized to substantially conform with said back section, and means for detachably inter-engaging said storage bag with its one wall in facing engagement with said back section.

* * * * *